United States Patent [19]

Lassota

[11] Patent Number: 5,024,588

[45] Date of Patent: Jun. 18, 1991

[54] ROTARY COMPRESSOR AND PROCESS OF COMPRESSING COMPRESSIBLE FLUIDS WITH INTAKE AND DISCHARGE THROUGH PISTON SHAFT AND PISTON

[75] Inventor: Marek J. Lassota, Des Plaines, Ill.

[73] Assignee: Unotech Corporation, Villa Park, Ill.

[21] Appl. No.: 404,271

[22] Filed: Sep. 7, 1989

[51] Int. Cl.[5] ..... F04C 18/24; F04C 29/02

[52] U.S. Cl. ..... 418/1; 418/58; 418/88; 418/98; 418/100; 418/151; 418/187

[58] Field of Search ..... 418/1, 58, 88, 98, 100, 418/104, 151, 187; 417/462, 492

[56] References Cited

U.S. PATENT DOCUMENTS

| | | | |
|---|---|---|---|
| 1,864,699 | 6/1932 | Varley | 418/54 |
| 3,251,275 | 5/1966 | Rosenschold et al. | 417/462 |
| 4,135,864 | 1/1979 | Lassota | 418/1 |
| 4,137,021 | 1/1979 | Lassota | 418/1 |
| 4,137,022 | 1/1979 | Lassota | 418/1 |
| 4,174,195 | 11/1979 | Lassota | 418/1 |
| 4,431,356 | 2/1984 | Lassota | 418/58 |
| 4,553,912 | 11/1985 | Lassota | 418/54 |
| 4,773,836 | 9/1988 | Moore | 418/98 |

*Primary Examiner*—John J. Vrablik

*Attorney, Agent, or Firm*—Thomas W. Speckman; Douglas H. Pauley

[57] ABSTRACT

A rotary compressor and process of compressing compressible fluids wherein the compressor comprises a housing having at least two axially spaced walls and rotatable in relation to the housing cylinder-piston and piston elements journaled on eccentric portions of cylinder-piston and piston shafts rotating in opposite directions. The axially spaced walls of the housing form stationary walls, and the cylinder-piston and piston elements form moveable walls of at least two compression chambers. Circulated compressible fluid is drawn into the compression chambers through intake channel and intake port in the piston shaft and ports in the piston element, and discharged after compression through the same ports in the piston element, and through discharge port and into the discharge channel located in the piston shaft.

65 Claims, 7 Drawing Sheets

ROTARY COMPRESSOR AND PROCESS OF COMPRESSING COMPRESSIBLE FLUIDS WITH INTAKE AND DISCHARGE THROUGH PISTON SHAFT AND PISTON

BACKGROUND OF THE INVENTION

This invention relates in general to a compressor and process of compressing, and more particularly to a positive displacement rotary compressor and process of compressing compressible fluids, such as air and other gases.

At the present time, reciprocating piston and rotary screw compressors dominate the air compressor markets in sizes of up to 150 hp. The valveless, single stage, lubricant flooded and cooled compressor of this invention is a simple, well balanced machine with design, performance and cost advantages over both piston and screw compressors. In particular, the compressor of this invention is a positive displacement machine that combines the following major advantages of:

1. The reciprocating piston compressor-such as simple design utilizing common, inexpensive materials and production techniques, basically reciprocating characteristics of the compression process, good sealing of the compression chambers and high efficiency; and 2. Screw compressors-such as compact, lightweight, single stage, valveless and lubricant flooded and cooled design that is heavy duty, balanced, vibrationless, quiet and reliable in operation.

At the same time, the compressor of this invention is also a design that eliminates the following disadvantages of:

1. The reciprocating piston compressor-reciprocating motion of the pistons and connecting rods, need for suction and discharge valves, bulky and heavy design, slow speed and double stage operation that is required to maintain reasonable discharge temperatures and good efficiency; and 2. Screw compressors-expensive design resulting from precision and costly machining of geometrically complex rotors that require expensive, specialized, single purpose manufacturing equipment, and low efficiency resulting from inherent internal leakage (of air under compression) between the suction and discharge spaces due to a lack of positive sealing between rotors, and between rotors and the housing.

In addition to all above, the compressor of this invention is an improvement over a rotary compressor of my earlier inventions, more fully described in my issued U.S. Pats. No.: 4,135,864; 4,137,021; 4,137,022; 4,174,195 and 4,553,912, all of which are incorporated herein in their entirety by reference, by eliminating the need for the intake and/or discharge valves.

SUMMARY OF THE INVENTION

The rotary compressor of this invention comprises generally an outer housing enclosing an inner housing within which rotatable cylinder-piston and piston elements are received. The inner housing comprises at least two axially spaced walls, and the cylinder-piston and piston are operatively positioned between and adjacent to them. The cylinder-piston and piston are journaled on eccentric portions of their shafts, which have the eccentric portions disposed between the axially spaced walls of the inner housing. The shafts are journaled in axially spaced walls of the inner housing and are interconnected by gearing means to transmit power from a drive shaft to a driven shaft and to coordinate their movements in such a way so the shafts rotate in coordinated rotations in opposite directions with equal rotational speeds. The cylinder-piston and piston follow coordinated planetary movements in opposite directions with and about the eccentric portions of their shafts and form moveable walls of at least one compression chamber, whereas the stationary walls of the compression chamber are formed by the axially spaced walls of the inner housing.

Intake charge of fluid to be compressed by the compressor of this invention is drawn into the compression chambers through intake channel and intake port in the eccentric portion of the piston shaft and ports in the piston element, and discharged after compression through the same ports in the piston element, and through discharge port in the eccentric portion and into the discharge channel located in the piston shaft, and further into the discharge manifold. The intake and discharge ports of the piston shaft, and the ports of the piston are sequentially opened and closed by the rotation of the eccentric of the piston shaft in the bearing of the piston, and are sequentially communicating with the intake and discharge channels of the piston shaft.

To fully realize its advantages, the rotary compressor of this invention should be provided with injection of suitable lubricant into the intake channel, or directly into the compression chambers, to directly cool the compression process and control the discharge temperatures. In addition, such lubricant may lubricate the co-working surfaces of the cylinder-piston, piston and stationary walls of the housing, and improve the control of the internal leakage between the cylinder-piston and piston, and between the cylinder-piston and piston and adjacent spaced walls of the housing as a result of hydrodynamic sealing between co-working elements resulting from the use of lubricant of suitable viscosity and a combination of suitable running clearances between co-working elements, suitable surface finish and suitable speed of the compressor. The same lubricant used as a lubricating, cooling and sealing medium can be used to lubricate bearings and gear transmission of the compressor of this invention.

OBJECTS OF THE INVENTION

One object of the present invention is to provide a rotary compressor simple in construction, compact and lightweight.

Another object of the present invention is to provide a rotary valveless compressor having an intake system with intake ports and discharge system with discharge ports.

Still another object of the present invention is to provide a compressor with liquid injection to cool the compression process, lubricate the co-working surfaces and seal the compression chambers.

Yet another object of the present invention is to provide a compressor that is efficient in operation.

Another object of the present invention is to provide a rotary compressor capable of well balanced operation over a wide range of operating speeds.

Still another object of the present invention is to provide a rotary compressor capable of long and trouble-free service life.

Another object of the present invention is to provide a new process of compressing compressible fluids by the rotary compressor of this invention.

These and other objects of the present invention will become apparent when reading the annexed detailed description in the view of the drawings.

BRIEF DESCRIPTION OF THE DRAWINGS

FIG. 9 shows the end of the compression stroke and the beginning of the intake stroke in the first, or left compression chamber, as it is at about its minimum volume, and the end of the intake stroke and the beginning of the compression stroke in the second, or right compression chamber, as it is at about its maximum volume.

FIG. 10 shows the intake stroke in progress in the first compression chamber with its intake port almost fully open to the intake channel of the timing shaft, and the compression stroke in progress in the second compression chamber.

FIG. 11 shows the middle of the intake stroke in the first compression chamber with its intake port fully open to the intake channel of the timing shaft, and the compression stroke in progress in the second compression chamber.

FIG. 12 shows the second part of the intake stroke in the first compression chamber with its intake port still fully open to the intake channel of the timing shaft. In the second compression chamber, the discharge of the compressed air is in progress as the piston port is partially opened to the discharge channel of the timing shaft.

FIG. 13 shows the end of the intake stroke and the beginning of the compression stroke in the first compression chamber with its intake port fully closed, and the end of the discharge of the compressed air from second compression chamber as it is at about its minimum volume.

FIG. 14 shows the compression stroke in progress in the first compression chamber, and the intake stroke in progress in the second compression chamber where the intake port is almost fully open to the intake channel of the timing shaft.

FIG. 15 shows the compression stroke in progress in the first compression chamber and the intake stroke in progress in the second compression chamber where the intake port is fully open.

FIG. 16 shows the compression stroke nearing its end in the first compression chamber with its discharge port partially open to the discharge channel of the timing shaft, with the intake stroke in the second compression chamber almost completed.

DESCRIPTION OF PREFERRED EMBODIMENTS

Figure 1:
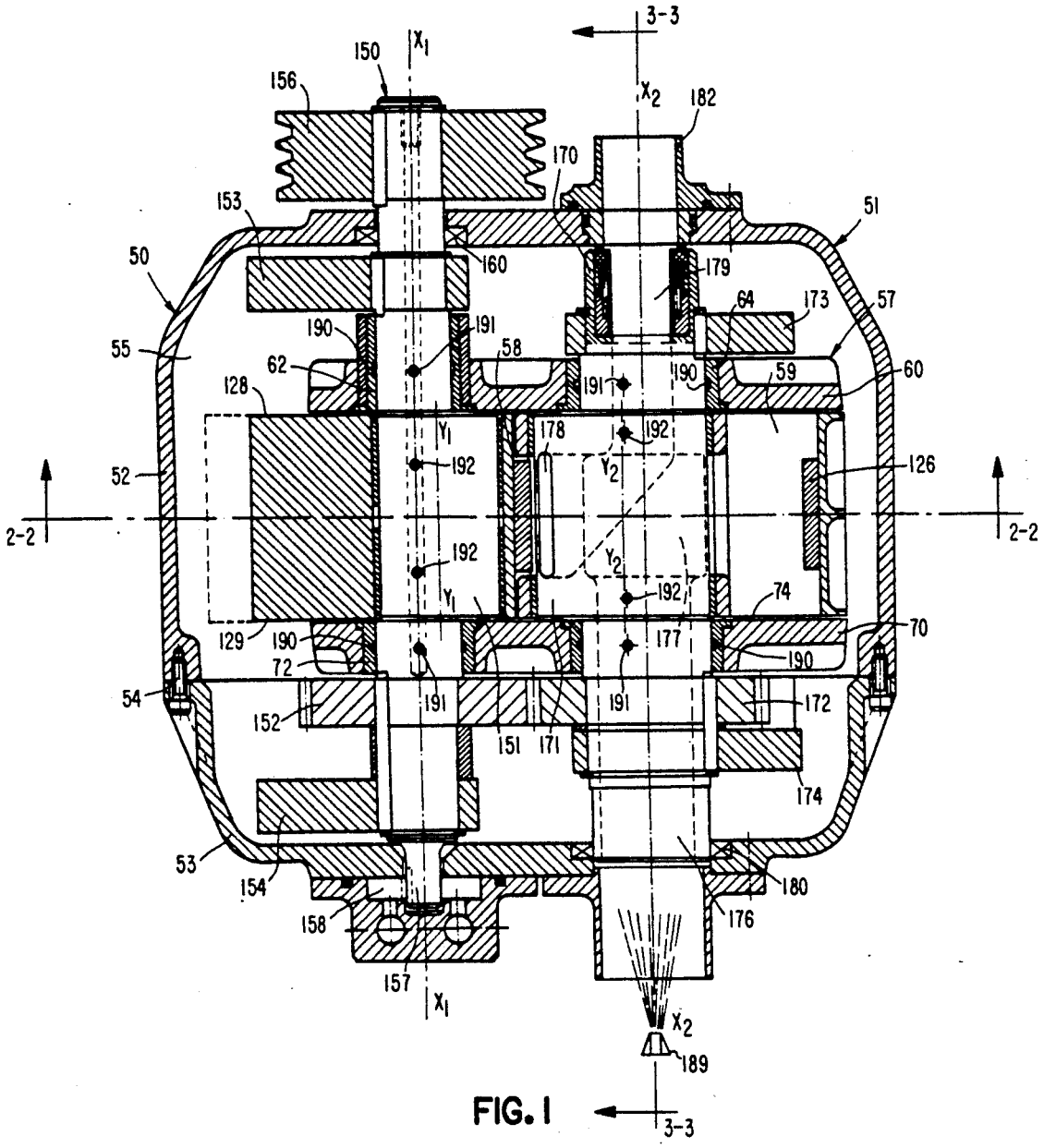
FIG. 1 is a longitudinal sectional view through a rotary compressor embodying this invention having two compression chambers, taken along lines 1—1 in FIGS. 2 and 3.
Figure 2:
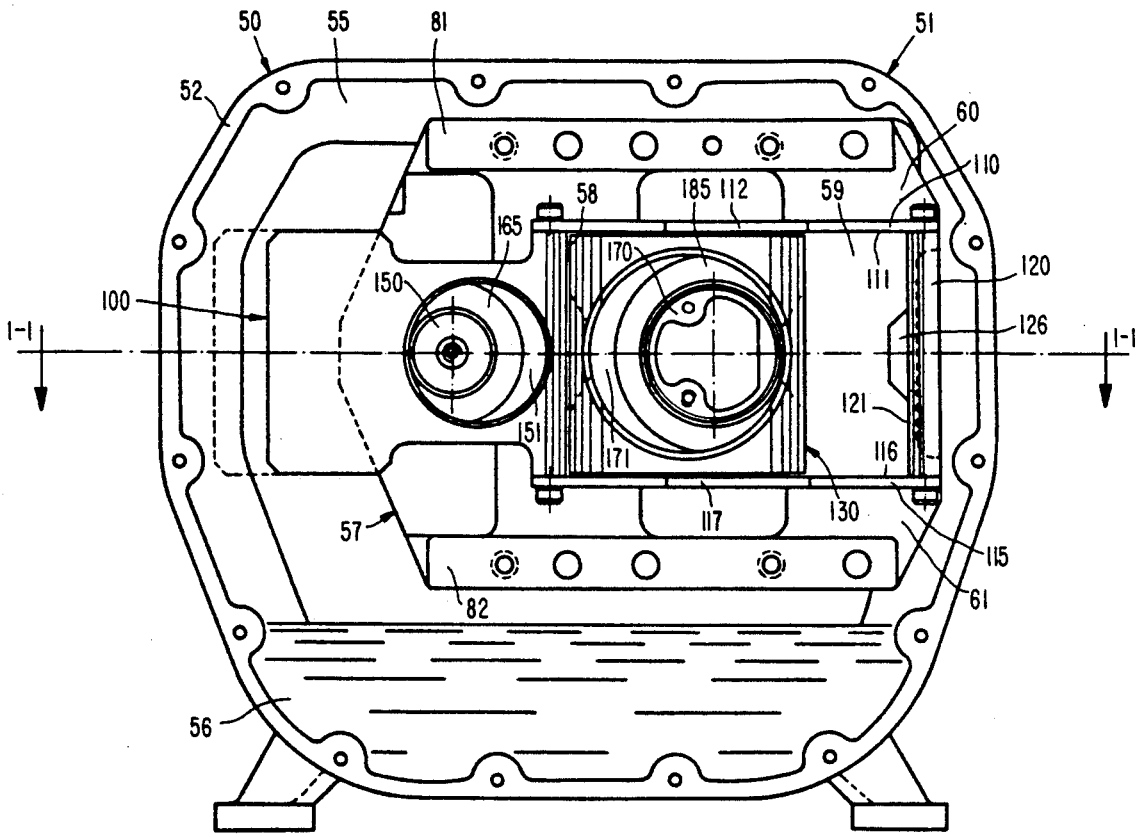
FIG. 2 is a transverse vertical view taken along line 2—2 of FIG. 1 and showing both cylinder-piston and piston elements journaled on eccentric portions of their shafts.
Figure 3:
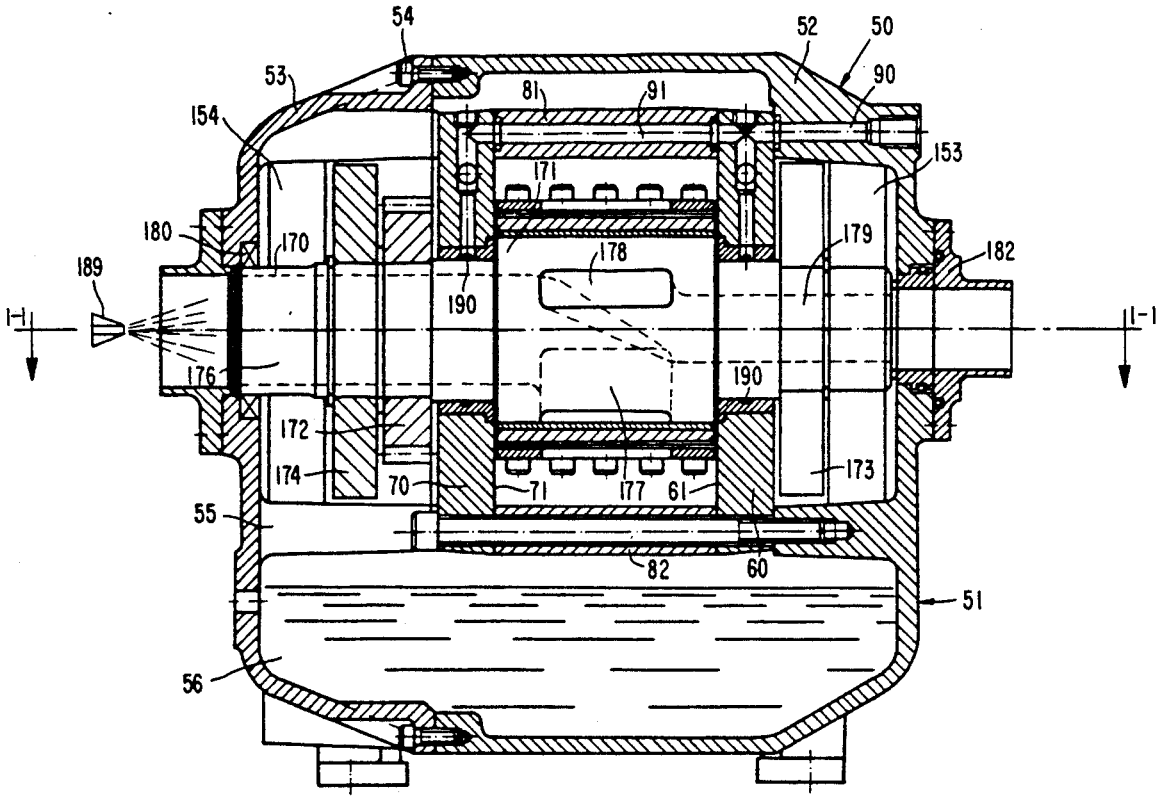
FIG. 3 is a vertical sectional view taken along line 3—3 of FIG. 1 and showing a cross section through the piston shaft with its intake and discharge channels and ports.

Referring first to FIGS. 1, 2 and 3 of the drawings, a rotary compressor of this invention is indicated by numeral 50. Compressor 50 comprises an outer housing 51, comprising main housing 52 and cover 53, bolted by bolts 54. Outer housing 51 forms cavity 55 within which inner housing 57 (best shown in perspective view of FIG. 5) is received, and bottom of which forms oil sump 56. Inner housing 57 is formed by walls 60 and 70, axially spaced by top spacer 81 and bottom spacer 82. Between axially spaced walls 60 and 70 of the inner housing 57, cylinder-piston 100 and piston 130 are journaled on eccentric portions 151 and 171 of rotatable shafts 150 and 170. Axially spaced walls 60 and 70 form stationary walls, and cylinder-piston 100 and piston 130 form moveable walls of two compression chambers 58 and 59.

The major components of the compressor of this invention will now be described in detail sufficient for understanding of its operation and advantages.

Figure 6:
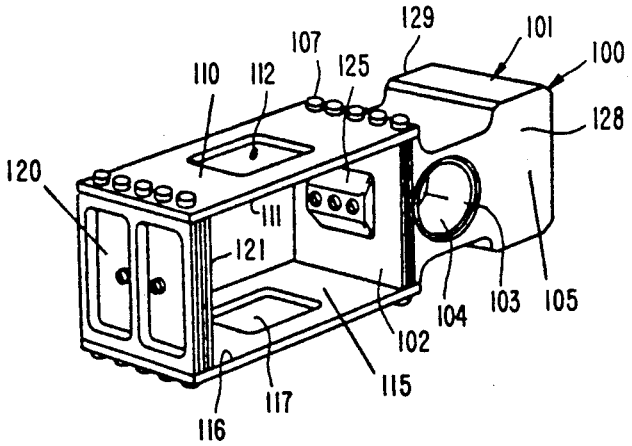
FIG. 6 is a perspective view of the cylinder-piston.

Cylinder-piston 100 is best shown in view of FIG. 6. The term "cylinder-piston" refers to an element operating as both a cylinder and a piston, although the configuration of this element is not at all geometrically cylindrical.

Cylinder-piston 100 comprises body 101 and spaced walls 110 and 115 extending from body 101 and connected at their ends remote from body 101 by connecting wall 120. Spaced walls 110 and 115 are bolted to body 101 and connecting wall 120 by suitable bolts or screws 107.

Spaced walls 110 and 115 have opposing parallel surfaces 111 and 116, body 101 has surface 102, and connecting wall 120 has surface 121. Surfaces 111, 116, 102 and 121 define an opening in cylinder-piston 100 in which piston 130 operates. Surfaces 111, 116 and 102 form three of four moveable walls of first compression chamber 58, and surfaces 111, 116 and 121 form three of four moveable surfaces of second compression chamber 59.

Bearing 104, made of one or more sections, is located in housing 103 of body 101. The portion 105 of body 101, remote from spaced walls 110 and 115 is sufficiently large to act as balancing means to balance cylinder-piston 100 by making a center of gravity of cylinder piston 100 located on or close to the axis of its bearing 104. Balancing weights may also be used in portion 105 of body 101 to obtain good balance, particularly when the cylinder-piston 100 is constructed of lightweight material.

Cylinder-piston 100 comprises also two port fillers 125 and 126 (port filler 126 is best visible in views of FIGS. 1 and 2). Port fillers 125 and 126, made preferably from light-weight material, are provided to partially fill-in the space in the intake-discharge ports 142 and 141 of piston 130 when the volumes of compression chambers 58 and 59 are at or close to their minimum volumes, to decrease to maximum the dead or clearance volume of compression chambers. Port filler 125 may be secured to surface 102 of cylinder-piston body 101, and port filler 126 may be secured to surface 121 of connecting wall 120 by any suitable means, such as suitable bolts or screws.

Figure 7:
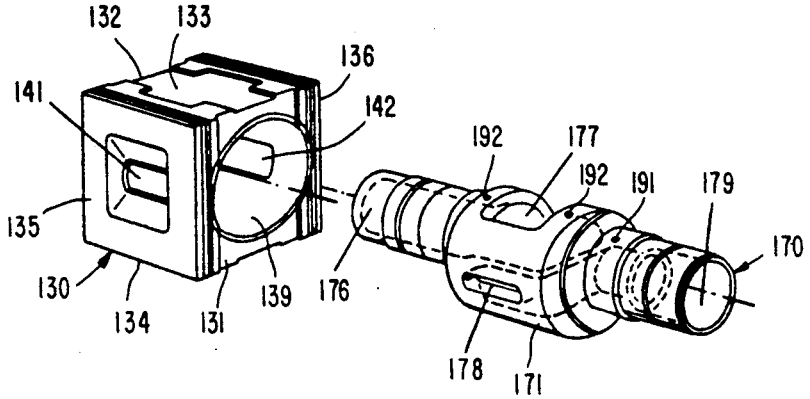
FIG. 7 is a perspective view of the piston and piston shaft, showing the piston ports and shaft intake and discharge channels and intake and discharge ports.

Piston 130 is best shown in view of FIG. 7, on the left side of FIG. 7. Piston 130 has spaced side faces 131 and 132 interconnected by passageway in which bearing 139 is mounted. Piston 130 has also pair of spaced faces 133 (top) and 134 (bottom), and pair of end faces 135 and 136. End face 136 connects spaced side faces 131 and 132 and spaced faces 133 and 134 and forms fourth moveable surface of compression chamber 58, changing the volume of compression chamber 58 during the operation of the compressor. Likewise, end face 135 connects spaced side faces 131 and 132 and spaced faces 133 and 134 and forms fourth moveable surface of compression chamber 59, changing the volume of compression chamber 59 during the operation of the compressor of this invention.

Piston 130 has two substantially rectangular openings, or ports 141 and 142 in its end faces 135 and 136, respectively. Ports 141 and 142 communicate with the intake and discharge ports and channels of piston shaft 170 to serve as an intake and discharge means during the operation of the compressor of this invention.

The width of piston 130, measured along axis Y2—Y2 of its bearing 139 is coextensive with the width of cylinder-piston 100, measured along axis Y1—Y1 of its bearing 104.

Due to its symmetrical shape piston 130 can be readily balanced to have its center of gravity located on or close to the axis Y2—Y2 which is common for bearing 139 and eccentric portion 171 of shaft 170.

Cylinder-piston 100 and piston 130 are assembled on and are moved by eccentric portions 151 and 171 of two eccentric shafts 150 and 170 during the operation of the compressor of this invention. Both shafts 150 and 170 are best visible in view of FIG. 1, and shaft 170 is best visible in views of FIGS. 3 and 7.

Eccentric portions 151 and 171 can be cranks when shafts 150 and 170 are crankshafts, or they can be eccentrics when shafts 150 and 170 are eccentric shafts. Eccentric portions 151 and 171 have axes Y1—Y1 and Y2—Y2 eccentric from and parallel to axes X1—X1 and X2—X2 of shafts 150 and 170, respectively.

Cylinder-piston shaft 150 is best shown in FIG. 1. Shaft 150 has eccentric 151, and together with V-belt sheave 156 (or any other suitable coupling to the drive motor) on one end, may serve as a power input shaft to the compressor. At the second end opposite to the V-belt sheave or coupling, cylinder-piston shaft 150 may have a drive end 157 to drive any suitable oil pump 158.

Piston shaft 170 is best shown in views of FIGS. 1 and 3, and in perspective in view of FIG. 7, showing its internal structures. Piston shaft 170 serves dual functions as a piston shaft, causing piston 130 to rotate in coordinated rotations with cylinder-piston 100, and as a major component of the compressor intake and discharge systems. Piston shaft 170 has an intake channel 176 starting at one end of the shaft and ending as an intake port 177 in the eccentric section 171 of shaft 170. The discharge port 178 is located in another section of eccentric section 171, continuing into the discharge channel 179 ending at a second end of piston shaft opposite from intake channel 176.

Figure 8:
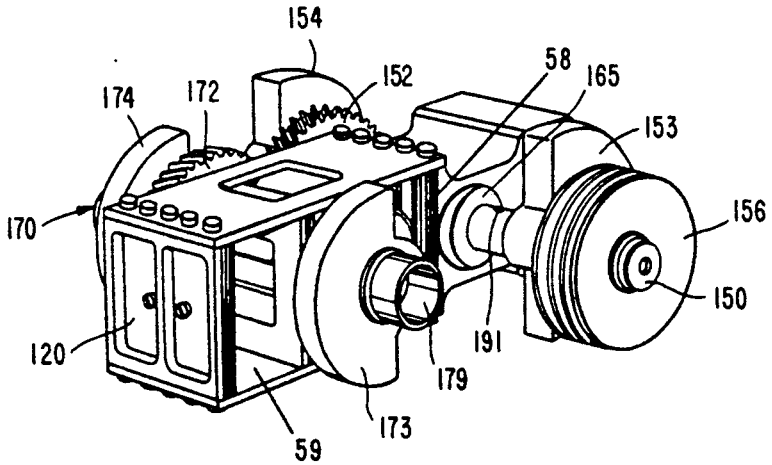
FIG. 8 is a perspective view of the cylinder-piston and piston elements assembled on their shafts.

Both cylinder-piston shaft 150 and piston shaft 170 may have, on both sides of their eccentrics 151 and 171, flat thrust bearing surfaces 165 and 185, respectively, which are best visible in views of FIGS. 2, 7 and 8.

Figure 4:
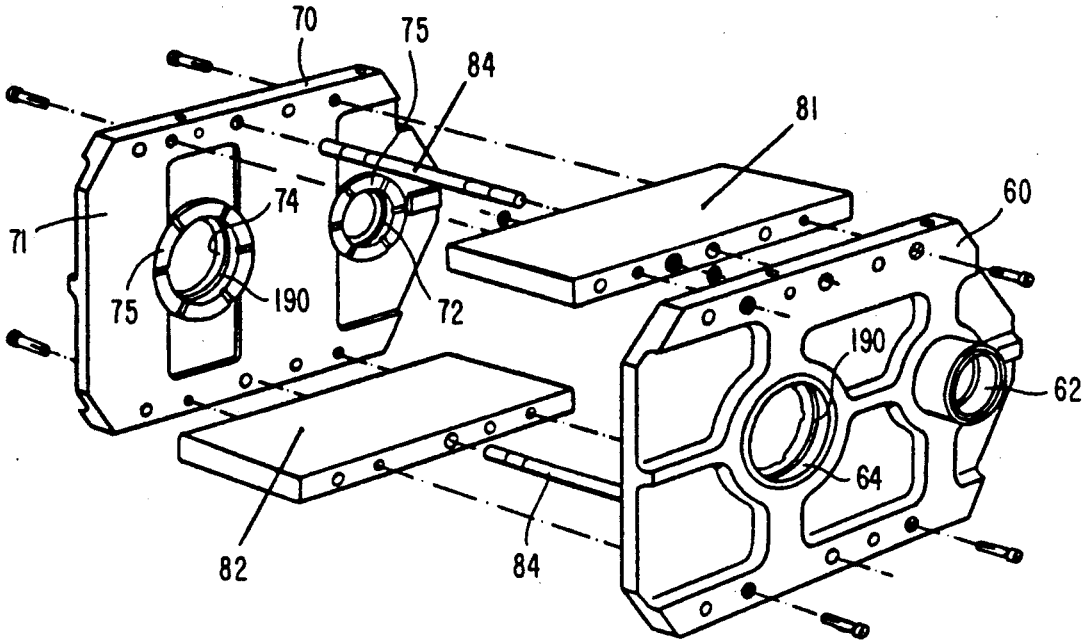
FIG. 4 is a perspective exploded view of the components of the inner housing of the compressor of this invention.
Figure 5:
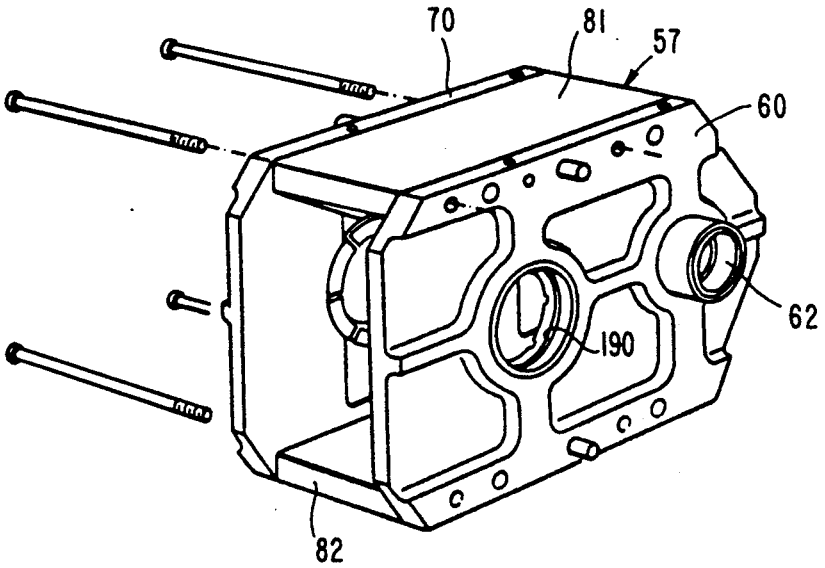
FIG. 5 is a perspective view of the inner housing of the compressor of this invention assembled.

Spaced walls 60 and 70 of the inner housing 57 are best shown in views of FIGS. 1, 2 and 3, and in perspective views of FIGS. 4 and 5. In the embodiment illustrated spaced walls 60 and 70 are spaced axially along axes X1—X1 and X2—X2 of shafts 150 and 170 by spacers 81 and 82 positioned between surfaces 61 and 71 of spaced walls 60 and 70. Any suitable spacing means, different from those described, can be used to axially space walls 60 and 70 as required for operation of cylinder-piston 100 and piston 130 and shafts 150 and 170.

Spaced wall 60 has bearings 62 and 64, and spaced wall 70 has bearings 72 and 74, to radially support and journal shafts 150 and 170. Bearings 62 and 64 of spaced wall 60 have flat thrust surfaces 65 (invisible in views of FIGS. 4 and 5), and bearings 72 and 74 of spaced wall 70 have flat thrust surfaces 75. Flat thrust surfaces 65 of bearings 62 and 64, and flat thrust surfaces of bearings 72 and 74 may have suitable grooves to help distribute oil between surfaces 65 and 75 and flat thrust bearing surfaces 165 and 185 of shafts 150 and 170, respectively.

Spaced walls 60 and 70 are aligned by suitable aligning means, as for example suitable dowel pins 84, to provide for required alignment of bearings 62 and 72 of cylinder-piston shaft 150, and bearings 64 and 74 of piston shaft 170.

Assembled rotary compressor of the embodiment illustrated is best shown in FIGS. 1 through 3, and in FIGS. 9 through 16.

Cylinder-piston 100 is journaled on eccentric portion 151 of shaft 150; piston 130 is journaled on eccentric portion 171 of shaft 170 and is slidably postioned between spaced walls 110 and 115 of cylinder-piston 100, which is best visible in view of FIG. 2, and in FIGS. 9 through 16.

Cylinder-piston shaft 150 is journaled in bearings 62 and 72, supported in walls 60 and 70, and piston shaft 170 is journaled in bearings 64 and 74, also supported in walls 60 and 70. Shafts 150 and 170 are spaced as required for meshing of gears 152 and 172 and operation of cylinder-piston 100 and piston 130, and are rotating around axes X1—X1 and X2—X2. This is best seen in views of FIGS. 1 and 2. In addition, both shafts 150 and 170 are positioned axially in such a way that their flat bearing surfaces 165 and 185 are disposed between and adjacent to thrust surfaces 65 of bearings 62 and 64, and thrust surfaces 75 of bearings 72 and 74.

Cylinder-piston shaft 150 and piston shaft 170 are interconnected by gear transmission comprising cylinder-piston shaft 150 gear 152 and piston shaft 170 gear 172. In the embodiment illustrated, both gears 152 and 172 may be any suitable spur or helical gears, having the same number of teeth, and are used to transmit power from the power input cylinder-piston shaft 150 to the driven, or piston shaft 170, and to coordinate the rotations of both shafts so they rotate in coordinated rotations with equal rotational speeds in opposite directions. Cylinder-piston 100 and piston 130 follow coordinated planetary movements in opposite directions with and around eccentric portions 151 and 171 of shafts 150 and 170, with piston 130 slidably positioned between spaced walls 110 and 115 of cylinder-piston 100. Spaced faces 133 and 134 of piston 130 are disposed adjacent to opposing parallel surfaces 111 and 116 of spaced walls 110 and 115 of cylinder-piston 100. Side face 128 of cylinder-piston 100 and spaced side face 131 of piston 130 are adjacent to surface 61 of wall 60, and side face 129 of cylinder-piston 100 and spaced side face 132 of piston 130 are adjacent to surface 71 of spaced wall 70. Surfaces 111, 116 and 102 of cylinder-piston 100, and end face 136 of piston 130 form moveable surfaces of compression chamber 58, while surface 121 of connecting wall 120, and surfaces 111 and 116 of spaced walls 110 and 115 of cylinder-piston 100, together with end face 135 of piston 130, form moveable surfaces of second compression chamber 59. Stationary surfaces of compression chambers 58 and 59 are formed by surfaces 61 and 71 of spaced walls 60 and 70 of inner housing 57. Movement of surface 136 of piston 130 with respect to surfaces 111, 116 and 102 of cylinder-piston 100 changes volume of compression chamber 58, while movement of surface 135 of piston 130 with respect to surfaces 111, 116 and 121 of cylinder-piston 100 changes volume of compression chamber 59. This is best illustrated in FIGS. 9 through 16.

Balancing means for balancing of cylinder-piston shaft 150 comprises balancing elements 153 and 154, suitably secured to shaft 150. Similiarly, balancing means for balancing of piston shaft 170 comprises balancing elements 173 and 174, suitably secured to shaft 170. Properly balanced shafts 150 and 170 have their centers of gravity located on or close to their axes of rotation X1—X1 and X2—X2, as required for the balanced operation of the compressor of this invention.

During the operation of the compressor of this invention, the intake and discharge ports 177 and 178 of piston shaft 170 communicate sequentially with ports 141 and 142 in piston 130, providing for timed flow of the fresh intake fluid to the compressor and discharge of the compressed fluid. This is best visible in views of FIGS. 9 through 16, showing eight representative positions of cylinder-piston 100 and piston 130 and their shafts 150 and 170.

For efficient operation of the rotary compressor embodying this invention, its compression chamber should be sealed. One solution is to sealingly engage all moveable and stationary elements forming compression chambers 58 and 59. Such sealing engagement between spaced sides 133 and 134 of piston 130 disposed adjacent to opposing parallel surfaces 111 and 116 of walls 110 and 115 of cylinder-piston 100; between side face 128 of cylinder-piston 100 and spaced side face 132 of piston 130 adjacent to surface 61 of wall 60, and between side face 129 of cylinder-piston 100 and spaced side face 131 of piston 130 adjacent to surface 71 of spaced wall 70 can result from a combination of suitable clearances between these elements, suitable finish of their surfaces, use of lubricant of suitable viscosity and suitable rotational speed of the compressor, as known in the art.

However, any suitable sealing system different from systems above described can be used to seal compression chambers 58 and 59 without departing from the spirit of this invention. Also, a combination of a sealing system comprising sealing elements between some of coacting surfaces with the system without sealing elements between other coacting surfaces forming compression chambers can be used. In some instances, outer housing 51 can be made as a pressure tight vessel, and an interior 55 of outer housing 51 can be pressurized to a certain pressure to minimize leakage from compression chambers 58 and 59 into cavity 55 regardless of the type of sealing system used to seal compression chambers.

The complete compressor of this invention may be enclosed in and attached to suitable outer housing 51, comprising two sections 52 and 53, bolted together by bolts 54. The bottom of housing 51 may form an oil sump 56 to contain suitable lubricant for lubricating, cooling and sealing of the compressor of this invention during its operation.

Parallel walls 110 and 115 of cylinder-piston 100 may further comprise substantially rectangular openings 112 and 117, respectively, sequentially opened and closed during the operation of compressor 50 of this invention by piston 130 to provide communication between compression chambers 58 and 59 and cavity 55 of outer housing 51 of compressor 50 in order to equalize pressure in compression chambers 58 and 59 and cavity 55 of outer housing 51 of compressor 50 when compression chambers 58 and 59 are at or very close to their maximum volumes.

Compressor 50 of this invention may also comprise suitable oil and pressure seals 160 and 180 to seal cylinder-piston shaft 150 and piston shaft 170 to maintain certain operational pressure inside housing 51 during the operation of the compressor of this invention, and to prevent oil leaks from compressor housing 51.

During the operation of the rotary compressor of this invention, the compressed air or gas must be transferred from the discharge channel 179 of the piston shaft 170 to the stationary discharge manifold 182. This could be accomplished by the use of a suitable pressure seal between the discharge end of piston shaft 170 and stationary housing 51. Two types of pressure seals could be used: mechanical face seal or high pressure rubber lip seal. The mechanical face seal is employed in the embodiment illustrated in view of FIG. 1.

Also, in order to provide a compressor of this invention with a long, trouble free service life, the thrust load resulting from the discharge pressure acting on the discharge end of piston shaft 170 should be minimized to decrease the loading of flat thrust bearing surface 185 on the intake side of eccentric 171 of piston shaft 170 and flat thrust bearing surface 75 of bearing 74. In the embodiment illustrated, this is accomplished by a selection of helical gears with suitable direction (right or left) and helix angle for gears 152 and 172. During the operation of the compressor of this invention, the gear transmission transfers approximately half of the total compressor input torque from the drive shaft to the driven shaft or, in the embodiment illustrated, from the cylinder-piston shaft 150 to the piston shaft 170. Use of the properly selected combination of the direction and helix angle will result in the creation of, and the transfer of same size but of opposite direction, thrust load to piston shaft 170, acting to reduce the thrust load resulting from the discharge pressure acting on the discharge end of piston shaft 170. In properly designed transmission, the final thrust loads (resulting from the discharge thrust load on piston shaft 170 and use of helical gears 152 and 172 to transfer input torque) on thrust bearings of cylinder-piston shaft 150 and piston shaft 170 shall be approximately equal but of opposite directions.

Bearings of the rotary compressor of this invention can be lubricated by any suitable lubricant which can be delivered to the bearings by suitable delivery lines located in stationary elements or in rotating shafts in accordance with the recognized practice. In the embodiment illustrated, lubricant under pressure is delivered through inlet manifold 90 (see FIG. 3) to stationary wall 60, and then through channel 91 in top spacer 81 to second stationary wall 70, and down to bearings 64 and 74 of piston shaft 170. In a similar manner, oil could be delivered to bearings 62 and 72 of cylinder-piston shaft 150.

Bearings 62, 64, 72 and 74 may have suitable radial grooves 190 to deliver oil to holes 191 in shafts 150 and 170 for further delivery through holes 192 in eccentrics 151 and 171 of shafts 150 and 170 to bearings 104 and 139 of cylinder-piston 100 and piston 130.

The lubricant can be the same as lubricating gears 152 and 172 and coacting surfaces of cylinder-piston 100 and piston 130 and surfaces 61 and 71 of spaced walls 60 and 70. Lubricant from a suitable reservoir (not shown) can be distributed to lubricate bearings and other coacting surfaces by any suitable splash, gravity or pump-feed lubricating system. This compressor can also be built as an unlubricated or so-called oil-less machine by using suitable self-lubricating materials for bearings and coacting surfaces.

The rotary compressor of this invention can be constructed of any suitable materials dependent upon the particular use desired, such as various grades of cast iron and steel, and its bearings can be made of any suitable materials, such as for instance suitable grades of bronze, aluminum bronze, or the like. The compressor of this invention can be powered by any suitable prime mover such as electric motors or internal combustion engines.

It is understood that intake channels of the compressor of this invention can be connected to an appropriate source of compressible fluid, and discharge manifold can be connected to an appropriate receiver of compressed fluid. Flow of the intake charge is illustrated in FIGS. 9 through 16 by clear arrows, and the discharge flow is illustrated in these Figures by dotted arrows.

The intake system of the compressor of this invention can be equipped with a suitable injector 189 to inject oil or lubricant into intake channel 176 of piston shaft 170 to lubricate the coacting surfaces of said piston, said cylinder-piston and said two axially spaced walls forming compression chambers 58 and 59, to cool the compression process in and to seal compression chambers 58 and 59.

THE OPERATION OF THE COMPRESSOR OF THIS INVENTION

FIGS. 9 through 16 are transverse vertical views taken along the line 2—2 of FIG. 1 and showing eight representative positions of the piston and cylinder-piston elements during one full revolution of their eccentric shafts. This represents the full cycle of operation taking place in both compression chambers.

During the operation of the compressor of this invention, the power input, or cylinder-piston shaft and the piston shaft rotate in opposite directions with the same rotational speeds as a result of coupling by the gear transmission having a gear ratio of 1:1. The eccentrics of both shafts, having identical eccentricities synchronized in a proper position and timed by the gear transmission, move both the cylinder-piston and piston elements in rotary motions in opposite directions. The reciprocating motion of the piston in relation to the cylinder-piston is the result of both synchronized rotary movements.

During the full cycle of operation, the intake and discharge channels and ports of the timing, or piston eccentric shaft communicate sequentially through two ports of the piston element with both compression chambers, allowing for the timely intake of the circulated fluid through the intake channel and ports, its compression and subsequent discharge into the discharge channel of the piston shaft through the piston and piston shaft ports.

Figure 9:
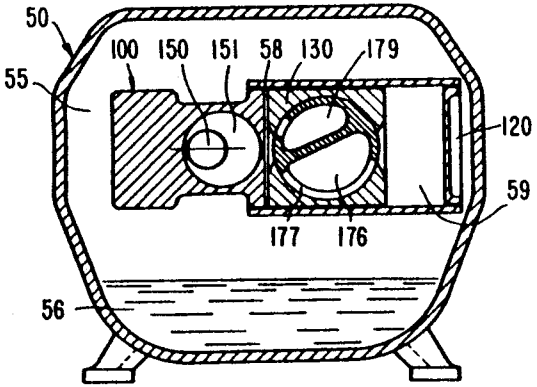

FIG. 9 shows the end of the compression stroke and the beginning of the intake stroke in compression chamber 58, as it is at about its minimum volume, and the end of the intake stroke and the begining of the compression stroke in compression chamber 59, which is at about its maximum volume.

Figure 10:
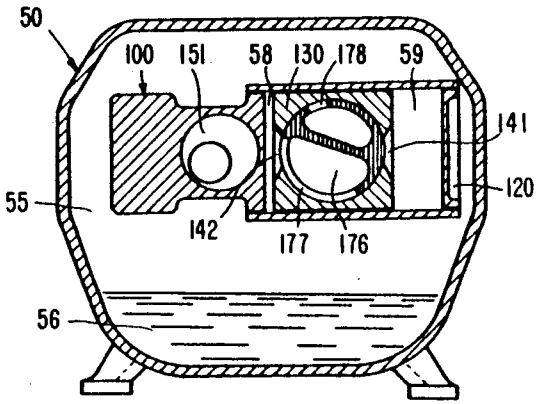

FIG. 10 shows the intake stroke in progress in compression chamber 58 with its intake port almost fully open to the intake channel 176 of piston shaft 170, and the compression stroke in progress in compression chamber 59.

Figure 11:
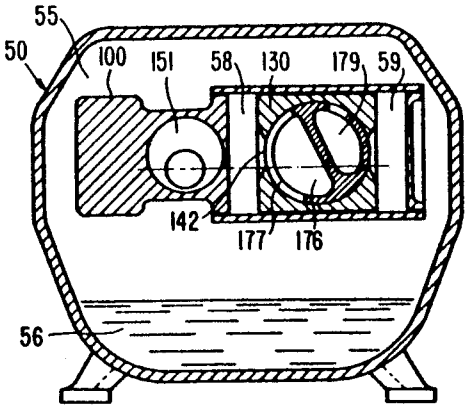
FIGS. 9 through 16 are transverse vertical views taken along the line 2—2 of FIG. 1 and showing eight representative positions of the piston and cylinder-piston elements during one full revolution of their eccentric shafts. This represents the full cycle of operation taking place in both compression chambers.

FIG. 11 shows the middle of the intake stroke in compression chamber 58 with its intake port fully open to intake channel 176 of piston shaft 170, and the compression stroke in progress in compression chamber 59.

Figure 12:
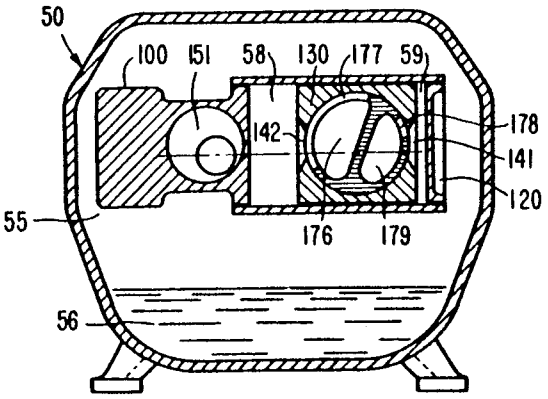

FIG. 12 shows the second part of the intake stroke in compression chamber 58 with its intake port still fully open to intake channel 176 of piston shaft 170. In compression chamber 59, the discharge of the compressed air is in progress as the piston port 142 is partially opened to discharge channel 179 of piston shaft 170.

Figure 13:
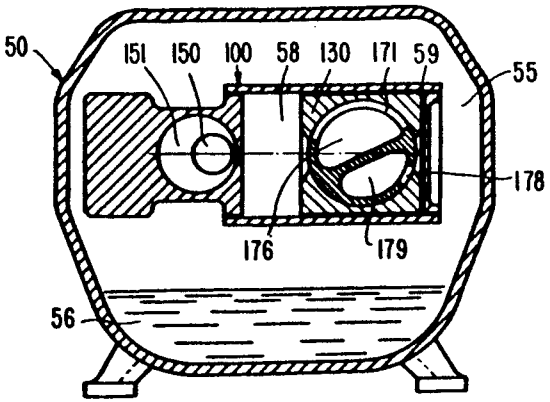

FIG. 13 shows the end of the intake stroke and the beginning of the compression stroke in compression chamber 58 with its intake port to intake channel 176 of piston shaft 170 fully closed, and the end of the discharge of the compressed air from compression chamber 59 as it is at about its minimum volume.

Figure 14:
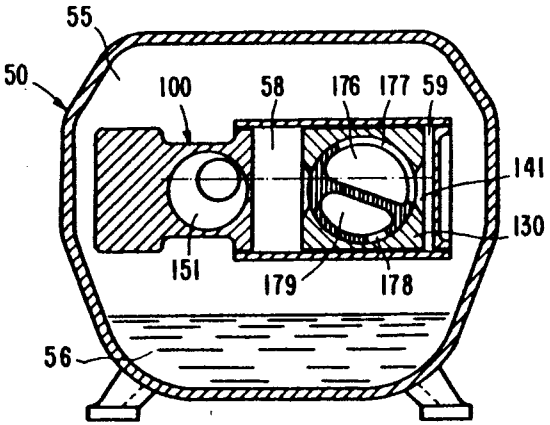

FIG. 14 shows the compression stroke in progess in compression chamber 58, and the intake stroke in progress in compression chamber 59 where the intake port is almost fully open to intake channel 176 of piston shaft 170.

Figure 15:
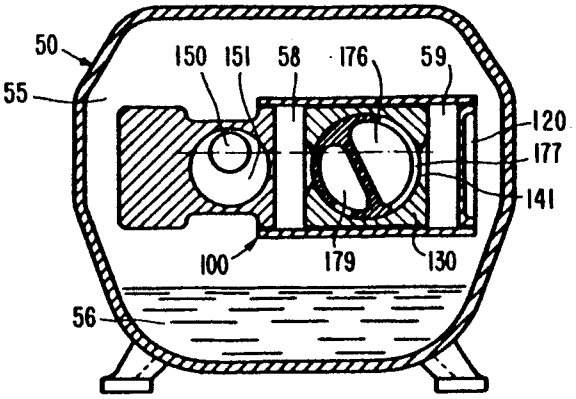

FIG. 15 shows the compression stroke in progress in compression chamber 58 and the intake stroke in progress in compression chamber 59 where the intake port to intake channel 176 of piston shaft 170 is fully open.

Figure 16:
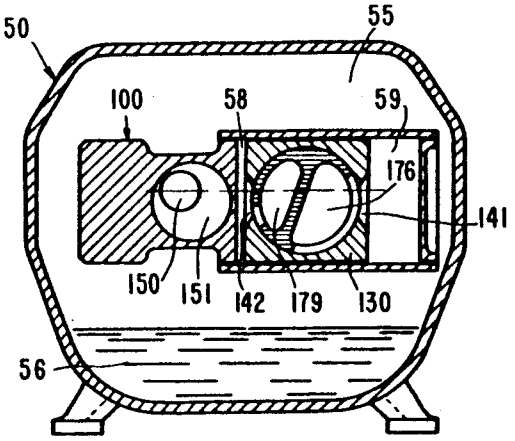

FIG. 16 shows the compression stroke nearing its end in compression chamber 58 with its discharge port partially open to discharge channel 179 of piston shaft 170, with the intake stroke in compression chamber 59 almost completed.

The full cycle of operation of the compressor of this invention as described above will be completed in both compression chambers 58 and 59 when the cylinder-piston 100 and piston 130 will again reach the positions as shown in FIG. 9.

During the operation, the lubricant should be continually injected into intake channel 176 of piston shaft 170 to lubricate all co-acting surfaces, directly cool the compression process (during the compression process, the lubricant in form of mist readily absorbs the heat of compression from the gas being compressed) and seal compression chambers 58 and 59. Some of this injected lubricant is squeezed between the co-working surfaces of cylinder-piston 100, piston 130 and spaced walls 60 and 70 of inner housing 57 while sealing compression chambers 58 and 59, while the remaining oil, entrained in the compressed air, is transported during the discharge from compression chambers 58 and 59 into discharge channel 179 of piston shaft 170 and outside of the compressor.

THE PROCESS OF COMPRESSING

A compressible fluid compressing process of my invention of a rotary compressor comprises sequentially:

opening an intake port leading into first compression chamber 58 (first compression chamber 58 located between body 101 and spaced walls 110 and 115 of cylinder-piston 100, piston 130 and spaced walls 60 and 70 of inner housing 57) as a result of overlapping of intake port 177 located in eccentric portion 171 of piston shaft 170 and port 141 located in piston 130 caused by a rotation of piston 130 on an eccentric 171 of rotating piston shaft 170 and when first compression chamber 58 is at about its minimum volume or shortly thereafter and after allowing for at least partial decompression of the residual compressed fluid;

closing an intake port leading into second compression chamber 59 (second compression chamber 59 located between two spaced walls 110 and 115 and connecting wall 120 of cylinder-piston 100, piston 130 and spaced walls 60 and 70 of inner housing 57), caused by a rotation of piston 130 on an eccentric 171 of the rotating piston shaft 170 and when second compression chamber 59 is at about its maximum volume or shortly thereafter if such later closing of the intake port is required to supercharge the compressor;

passing the compressible fluid to be compressed from intake channel 176 of piston shaft 170 through intake port 177 in eccentric 171 of piston shaft 170 and port 141 in end face 135 of piston 130 into first compression chamber 58 while the volume of first compression chamber 58 increases as a result of the coordinated and opposite planetary rotations of piston 130 and cylinder-piston 100 with a distance between piston 130 and body 101 of cylinder-piston 100 increasing;

compressing the compressible fluid in second compression chamber 59 by decreasing the volume of second compression chamber 59 as a result of the coordinated and opposite planetary rotations of cylinder-piston 100 and piston 130 while the distance between piston 130 and connecting wall 120 connecting two spaced walls 110 and 115 of cylinder-piston 100 decreases;

opening a discharge port leading from second compression chamber 59 into discharge channel 179 of piston shaft 170 as a result of overlapping of discharge port 178 located in eccentric portion 171 of piston shaft 170 and rectangular port 142 located in piston 130, and caused by a rotation of piston 130 on eccentric 171 of rotating piston shaft 170 and when the pressure of the compressible fluid being compressed in second compression chamber 59 reaches desired level, while continuing the intake process in first compression chamber 58;

passing the compressed compressible fluid from second compression chamber 59 through port 142 in piston 130 and discharge port 178 in eccentric portion 171 of piston shaft 170 and into discharge channel 179 in piston shaft 170 and into suitable receiver while the compression process in second compression chamber 59 continues and until second compression chamber 59 reaches its minimum volume, and while continuing the intake process in first compression chamber 58;

closing the discharge port of second compression chamber 59 as a result of a rotation of piston 130 on eccentric 171 of piston shaft 170 when second compression chamber 59 is at about its minimum volume;

opening the intake port leading into second compression chamber 59 as a result of overlapping of intake port 177 located in eccentric portion 171 of the piston shaft 170 and port 142 located in piston 130 caused by a rotation of piston 130 on eccentric 171 of rotating piston shaft 170, when first compression chamber 58 is at about its minimum volume or shortly thereafter and after allowing for at least partial de-compression of the residual compressed fluid;

closing the intake port of first compression chamber 58 as a result of a rotation of piston 130 on eccentric 171 of rotating piston shaft 170 when first compression chamber 58 is at about its maximum volume or shortly thereafter if such later closing of the intake port is required to supercharge compressor 50 compressing the compressible fluid in first compression chamber 58 by decreasing the volume of first compression chamber 58 as a result of the coordinated and opposite planetary rotations of cylinder-piston 100 and piston 130 while the distance between piston 130 and body 101 of cylinder-piston 100 decreases;

passing the compressible fluid to be compressed from intake channel 176 of piston shaft 170 through intake port 177 in eccentric 171 of piston shaft 170 and port 142 in piston 130 into second compression chamber 59 while the volume of second compression chamber 59 increases as a result of the coordinated and opposite planetary rotations of piston 130 and cylinder-piston 100 with a distance between piston 130 and connecting wall 120 connecting two spaced walls 110 and 115 of cylinder-piston 100 increasing; opening a discharge port leading from first compression chamber 58 into discharge channel 179 of piston shaft 170 as a result of overlapping of discharge port 178 located in eccentric portion 171 of piston shaft 170 and port 141 located in piston 130, and caused by a rotation of piston 130 on eccentric 171 of rotating piston shaft 170 and when the pressure of the fluid being compressed in first compression chamber 58 reaches desired level, while continuing the intake process in second compression chamber 59;

passing the compressed compressible fluid from first compression chamber 58 through port 141 in piston 130 and discharge port 178 in eccentric portion 171 of piston shaft 170 and into discharge channel 179 in piston shaft 170 and into suitable receiver while the compression process in first compression chambers 58 continues and until first compression chamber 58 reaches its minimum volume, and while continuing the intake process in second compression chamber 59;

closing the discharge port of first compression chamber 58 as a result of rotation of piston 130 on eccentric 171 of piston shaft 170 when first compression chamber 58 is at about its minimum volume; and repeating the cycle in first and second compression chambers 58 and 59.

I claim:

1. In a rotary compressor of the type comprising:

a cylinder-piston comprising a body, two spaced walls extending from one end of said body and having opposing parallel surfaces, and a wall interconnecting said two spaced walls at their ends remote from said body to form an opening in said cylinder-piston, said cylinder-piston further having two side faces;

a piston positioned within said opening of said cylinder-piston and having spaced faces adjoining said opposing parallel surfaces of said spaced walls of said cylinder-piston, said piston further having two spaced side faces;

two axially spaced walls adjoining said side faces of said cylinder-piston and said spaced side faces of said piston;

a rotatable cylinder-piston shaft comprising an eccentric portion journaled in said body of said cylinder-piston;

a rotatable piston shaft comprising an eccentric portion journaled in said piston;

gearing means interconnecting said cylinder-piston shaft and said piston shaft so said shafts follow coordinated rotations in opposite directions and said cylinder-piston and said piston follow coordinated planetary rotations in opposite directions with and around said eccentric portions of said shafts;

said cylinder-piston and said piston forming moveable surfaces, and said axially spaced walls forming stationary surfaces of two compression chambers located between said body of said cylinder-piston and said piston and between said piston and said wall interconnecting said two spaced walls of said cylinder-piston and varying in volumes upon said coordinated planetary rotations in opposite directions of said cylinder-piston and said piston;

intake means comprising intake ports leading to said compression chambers; and discharge means leading from said compression chambers, the improvement comprising:

said intake and discharge means comprising:

at least one port in each end face of said piston serving as intake and discharge ports;

an intake channel in said piston shaft in communication with at least one intake port located in said eccentric of said piston shaft, said intake port in said eccentric of said piston shaft communicating with said ports in said piston and leading to said compression chambers at intake positions of said cylinder-piston shaft, said cylinder-piston, said piston shaft and said piston; and a discharge port in said eccentric of said piston shaft in communication with a discharge channel of said piston shaft, said discharge ports of said piston communicating with said discharge port of said eccentric of said piston shaft and leading from said compression chambers at discharge positions of said cylinder-piston shaft, said cylinder-piston, said piston shaft and said piston; and a suitable housing enclosing said compressor with said compressor attached to said housing;

a suitable pressure seal between the end of said discharge channel of said piston shaft and said housing of said compressor to seal flow of compressed air or gas between said end of said discharge channel of said piston shaft and said compressor housing; and an opening in at least one of said parallel walls of said cylinder-piston, said opening being sequentially opened and closed during the operation of said compressor by said piston to provide communication between said compression chambers and inside of said housing of said compressor when said compression chambers are at or close to their maximum volumes.

2. The compressor of claim 1 wherein said two spaced walls of said cylinder-piston are bolted to said body of said cylinder-piston at one end, and to said wall interconnecting said two spaced walls of said cylinder-piston at the other end remote from said body of said cylinder-piston.

3. The compressor of claim 1 wherein said two axially spaced walls comprise bearings to radially journal said cylinder-piston shaft and said piston shaft.

4. The compressor of claim 3 wherein said bearings of said axially spaced walls further comprise bearing thrust portions to axially position said shafts between said axially spaced walls.

5. The compressor of claim 1 wherein said cylinder-piston shaft and said piston shaft are eccentric shafts and wherein said eccentric portions of said cylinder-piston shaft and said piston shaft are eccentrics.

6. The compressor of claim 1 wherein said opening in at least one of said parallel walls of said cylinder-piston is substantially rectangular in shape.

7. The compressor of claim 1 wherein said two axially spaced walls adjoining said side faces of said cylinder-piston and said spaced side faces of said piston are spaced by spacers positioned between said two axially spaced walls.

8. The compressor of claim 7 wherein said two axially spaced walls are aligned by aligning means to provide for aligning of said bearings in which said cylinder-piston shaft and said piston shaft are journaled.

9. The compressor of claim 8 wherein said aligning means are dowel pins.

10. The compressor of claim 1 wherein said eccentric portion of said cylinder-piston shaft is journaled in a bearing located in said body of said cylinder-piston, and wherein said eccentric portion of said piston shaft is journaled in a bearing located in said piston.

11. The compressor of claim 1 wherein said shafts comprise thrust bearing sections located on said eccentric portions to axially position said shafts between said thrust portions of said bearings of said axially spaced walls.

12. The compressor of claim 1 which further comprises lubricating and cooling means comprising:

a lubricant reservoir containing suitable lubricant;

means of delivery of said lubricant to said bearings located in said two axially spaced walls;

means of delivery of said lubricant from said bearings located in said two axially spaced walls to said bearings in said body of said cylinder-piston and in said piston;

means of delivery of said lubricant to said compression chambers to lubricate the co-acting surfaces of said piston, said cylinder-piston and said two axially spaced walls, to cool the compression process in said compression chambers and to seal said compression chambers.

13. The compressor of claim 12 wherein said means of delivery of said lubricant to said bearings of said two axially spaced walls comprise a network of suitable passages in said two axially spaced walls, said spacers spacing said two axially spaced walls, and housing of said compressor, said network of suitable passages connected to suitable source of said lubricant pressurized to a pressure as required for delivery of said lubricant to said bearings.

14. The compressor of claim 12 wherein said means of delivery of said lubricant to said bearings located in said body of said cylinder-piston comprise radial grooves in said bearings in said two axially spaced walls that support said cylinder-piston shaft, and suitable network of passages in said cylinder-piston shaft to deliver said lubricant from said radial grooves of said bearings of said two axially spaced walls to said bearings located in said body of said cylinder-piston.

15. The compressor of claim 12 wherein said means of delivery of said lubricant to said bearing of said piston comprise radial grooves in said bearings in said two axially spaced walls that support said piston shaft, and suitable network of passages in said piston shaft to deliver said lubricant from said radial grooves of said bearings of said two axially spaced walls to said bearing located in said piston.

16. The compressor of claim 12 wherein said means of delivery of said lubricant to said compression chambers to lubricate the co-acting surfaces of said piston, said cylinder-piston and said two axially spaced walls, to cool the compression process in said compression chambers and to seal said compression chambers comprise of injecting of said lubricant into said intake channel of said piston shaft so said injected lubricant is drawn into said compression chambers with the intake of fresh charge of air or gas to be compressed.

17. The compressor of claim 12 wherein said lubricant reservoir containing suitable lubricant for lubricating, cooling and sealing of said compressor is located at the bottom of said housing of said compressor.

18. The compressor of claim 1 wherein said cylinder-piston, said piston and said axially spaced walls are sealingly engaged in forming said compression chambers.

19. The compressor of claim 18 wherein said sealing engagement between said cylinder-piston, said piston and said two axially spaced walls results from a combination of suitable running clearances between said cylinder-piston and said piston and between said cylinder-piston, said piston and said two axially spaced walls; suitable finish of coating surfaces of said cylinder-piston, coacting surfaces of said piston and coacting surfaces of said two axially spaced walls; and use of lubricant of suitable viscosity to lubricate said coacting surfaces of said cylinder-piston, said piston and said two axially spaced walls.

20. The compressor of claim 1 which further comprises a balancing means, wherein said balancing means comprise cylinder-piston balancing means comprising a cylinder-piston balancing portion located in a part of said body of said cylinder-piston remote from said spaced walls and from said wall interconnecting said spaced walls, said balancing portion making the center of gravity of said cylinder-piston located on or close to the axis of said bearing located in said body of said cylinder-pistons; and wherein said balancing means futher comprise piston balancing means, said piston balancing means being such design of said piston so said piston has its center of gravity located on or close to the axis of said bearing located in said piston; and wherein said balancing means further comprise cylinder-piston shaft and piston shaft balancing means, said last mentioned means comprising balancing elements secured to said shafts and dynamically balancing said shafts with all elements assembled and journaled on said shafts.

21. The compressor of claim 1 wherein said gearing means comprise gears interconnecting said cylinder-piston and said piston shafts and wherein said gears have equal number of teeth so said shafts rotate with equal rotational speeds in opposite directions.

22. The compressor of claim 21 wherein said gears interconnecting said cylinder-piston shaft and said piston shaft are helical gears designed to transfer such portion of the thrust load of the said piston shaft that result from the discharge pressure acting upon one end of said piston shaft, to said cylinder-piston shaft as is required for equal loading of said thrust bearings of said bearings located in said two axially spaced walls.

23. The compressor of claim 1 wherein said housing comprises two sections bolted together.

24. The compressor of claim 1 wherein said intake port located in said eccentric of said piston shaft is sequentially opened by said piston to communicate through said ports in said piston with said compression chambers when said compression chambers are at about their minimum volumes, and wherein said intake port located in said eccentric of said piston shaft is sequentially closed by said piston when said compression chambers are at about their maximum volumes.

25. The compressor of claim 1 wherein said discharge port located in said eccentric of said piston shaft is sequentially opened by said piston to communicate through said ports in said piston with said compression chambers when the pressure of gas undergoing compression in said compression chambers reaches desired level, and wherein said discharge port located in said eccentric of said piston shaft is sequentially closed by said piston when said compression chambers are at about their minimum volumes.

26. The compressor of claim 1 wherein said cylinder-piston further comprises suitable port fillers, with one of said port fillers attached to a surface of said body of said cylinder-piston defining one of surfaces of said opening in said cylinder-piston, and second of said port fillers attached to a surface of said connecting wall of said cylinder-piston and defining another of surfaces of said opening in said cylinder-piston, said port fillers provided to partially fill-in the spaces in said ports of said piston when the volumes of said compression chambers are at or close to their minimum volumes to decrease the so called dead or clearance volume of said compressor.

27. The compressor of claim 1 wherein said suitable pressure seal is a mechanical face seal.

28. The compressor of claim 12 wherein said lubricating and cooling means further comprise a suitable oil pump to circulate said lubricant in a manner required for operation of said compressor.

29. The compressor of claim 28 wherein said oil pump is driven from one end of said cylinder-piston shaft.

30. The compressor of claim 12 wherein said compressor further comprises suitable oil and pressure seals to seal said cylinder-piston shaft and said piston shaft to maintain certain pressure inside said housing of said compressor during its operation, and to prevent oil leaks from said housing of said compressor.

31. The compressor of claim 1 wherein said cylinder-piston shaft serves as a compressor power input shaft.

32. A rotary compressor comprising:

a cylinder-piston comprising a body, two spaced walls extending from one end of said body and having opposing parallel surfaces, and a wall interconnecting said two spaced walls at their ends remote from said body to form an opening in said cylinder-piston, said cylinder-piston further having two side faces;

a piston positioned within said opening of said cylinder-piston and having spaced faces adjoining said opposing parallel surfaces of said spaced walls of said cylinder-piston, said piston further having two spaced side faces;

two axially spaced walls adjoining said side faces of said cylinder-piston and said spaced side faces of said piston;

a rotatable cylinder-piston shaft comprising an eccentric portion journaled in said body of said cylinder-piston;

a rotatable piston shaft comprising an eccentric portion journaled in said piston;

gearing means interconnecting said cylinder-piston shaft and said piston shaft so said shafts follow coordinated rotations in opposite directions and said cylinder-piston and said piston follow coordinated planetary rotations in opposite directions with and around said eccentric portions of said shafts;

said cylinder-piston and said piston forming moveable surfaces, and said axially spaced walls forming stationary surfaces of two compression chambers located between said body of said cylinder-piston and said piston and between said piston and said wall interconnecting said two spaced walls of said cylinder-piston and varying in volumes upon said coordinated planetary rotations in opposite directions of said cylinder-piston and said piston;

intake means leading to said compression chambers and discharge means leading from said compression chambers, said intake and discharge means comprising:

at least one port in each end face of said piston serving as intake and discharge ports;

an intake channel in said piston shaft in communication with at least one intake port located in said eccentric of said piston shaft, said intake port in said eccentric of said piston shaft communicating with said ports in said piston and leading to said compression chambers at intake positions of said cylinder-piston shaft, said cylinder-piston, said piston shaft and said piston; and a discharge port in said eccentric of said piston shaft in communication with a discharge channel of said piston shaft, said discharge ports of said piston communicating with said discharge port of said eccentric of said piston shaft and leading from said compression chambers at discharge positions of said cylinder-piston shaft, said cylinder-piston, said piston shaft and said piston; and a suitable housing enclosing said compressor with said compressor attached to said housing;

a suitable pressure seal between the end of said discharge channel of said piston shaft and said housing of said compressor to seal flow of compressed air or gas between said end of said discharge channel of said piston shaft and said compressor housing; and an opening in at least one of said parallel walls of said cylinder-piston, said opening being sequentially opened and closed during the operation of said compressor by said piston to provide communication between said compression chambers and inside of said housing of said compressor when said compression chambers are at or close to their maximum volumes.

33. The compressor of claim 32 wherein said two spaced walls of said cylinder-piston are bolted to said body of said cylinder-piston at one end, and to said wall interconnecting said two spaced walls of said cylinder-piston at the other end remote from said body of said cylinder-piston.

34. The compressor of claim 32 wherein said two axially spaced walls comprise bearings to radially journal said cylinder-piston shaft and said piston shaft.

35. The compressor of claim 34 wherein said bearings of said axially spaced walls further comprise bearing thrust portions to axially position said shafts between said axially spaced walls.

36. The compressor of claim 32 wherein said cylinder-piston shaft and said piston shaft are eccentric shafts and wherein said eccentric portions of said cylinder-piston shaft and said piston shaft are eccentrics.

37. The compressor of claim 32 wherein said opening in at least one of said parallel walls of said cylinder-piston is substantially rectangular in shape.

38. The compressor of claim 32 wherein said two axially spaced walls adjoining said side faces of said cylinder-piston and said spaced side faces of said piston are spaced by spacers positioned between said two axially spaced walls.

39. The compressor of claim 38 wherein said two axially spaced walls are aligned by aligning means to provide for aligning of said bearings in which said cylinder-piston shaft and said piston shaft are journaled.

40. The compressor of claim 39 wherein said aligning means are dowel pins.

41. The compressor of claim 32 wherein said eccentric portion of said cylinder-piston shaft is journaled in a bearing located in said body of said cylinder-piston, and wherein said eccentric portion of said piston shaft is journaled in a bearing located in said piston.

42. The compressor of claim 32 wherein said shafts comprise thrust bearing sections located on said eccentric portions to axially position said shafts between said thrust portions of said bearings of said axially spaced walls.

43. The compressor of claim 32 which further comprises lubricating and cooling means comprising:

a lubricant reservoir containing suitable lubricant;

means of delivery of said lubricant to said bearings located in said two axially spaced walls;

means of delivery of said lubricant from said bearings located in said two axially spaced walls to said bearings in said body of said cylinder-piston and in said piston;

means of delivery of said lubricant to said compression chambers to lubricate the co-acting surfaces of said piston, said cylinder-piston and said two axially spaced walls, to cool the compression process in said compression chambers and to seal said compression chambers.

44. The compressor of claim 43 wherein said means of delivery of said lubricant to said bearings of said two axially spaced walls comprise a network of suitable passages in said two axially spaced walls, said spacers spacing said two axially spaced walls, and housing of said compressor, said network of suitable passages connected to suitable source of said lubricant pressurized to a pressure as required for delivery of said lubricant to said bearings.

45. The compressor of claim 43 wherein said means of delivery of said lubricant to said bearings located in said body of said cylinder-piston comprise radial grooves in said bearings in said two axially spaced walls that support said cylinder-piston shaft, and suitable network of passages in said cylinder-piston shaft to deliver said lubricant from said radial grooves of said bearings of said two axially spaced walls to said bearings located in said body of said cylinder-piston.

46. The compressor of claim 43 wherein said means of delivery of said lubricant to said bearings of said piston comprise radial grooves in said bearings in said two axially spaced walls that support said piston shaft, and suitable network of passages in said piston shaft to deliver said lubricant from said radial grooves of said bearings of said two axially spaced walls to said bearing located in said piston.

47. The compressor of claim 43 wherein said means of delivery of said lubricant to said compression chambers to lubricate the co-acting surfaces of said piston, said cylinder-piston and said two axially spaced walls, to cool the compression process in said compression chambers and to seal said compression chambers comprise of injecting of said lubricant into said intake channel of said piston shaft so said injected lubricant is drawn into said compression chambers with the intake of fresh charge of air or gas to be compressed.

48. The compressor of claim 32 wherein said cylinder-piston, said piston and said axially spaced walls are sealingly engaged in forming said compression chambers.

49. The compressor of claim 48 wherein said sealing engagement between said cylinder-piston, said piston and said two axially spaced walls results from a combination of suitable running clearances between said cylinder-piston and said piston and between said cylinder-piston, said piston and said two axially spaced walls; suitable finish of coating surfaces of said cylinder-piston, coating surfaces of said piston and coating surfaces of said two axially spaced walls; and use of lubricant of suitable viscosity to lubricate said coating surfaces of said cylinder-piston, said piston and said two axially spaced walls.

50. The compressor of claim 32 which further comprises a balancing means, wherein said balancing means comprise cylinder-piston balancing means comprising a cylinder-piston balancing portion located in a part of said body of said cylinder-piston remote from said spaced walls and from said wall interconnecting said spaced walls, said balancing portion making the center of gravity of said cylinder-piston located on or close to the axis of said bearing located in said body of said cylinder-pistons; and wherein said balancing means further comprise piston balancing means, said piston balancing means being such design of said piston so said piston has its center of gravity located on or close to the axis of said bearing located in said piston; and wherein said balancing means further comprise cylinder-piston shaft and piston shaft balancing means, said last mentioned means comprising balancing elements secured to said shafts and dynamically balancing said shafts with all elements assembled and journaled on said shafts.

51. The compressor of claim 32 wherein said gearing means comprise gears interconnecting said cylinder-piston and said piston shafts and wherein said gears have equal number of teeth so said shafts rotate with equal rotational speeds in opposite directions.

52. The compressor of claim 51 wherein said gears interconnecting said cylinder-piston shaft and said piston shaft are helical gears designed to transfer such portion of the thrust load of the said piston shaft that result from the discharge pressure acting upon one end of said piston shaft, to said cylinder-piston shaft as is required for equal loading of said thrust bearings of said bearings located in said two axially spaced walls.

53. The compressor of claim 32 wherein said housing comprises two sections bolted together.

54. The compressor of claim 43 wherein said lubricant reservoir containing suitable lubricant for lubricating, cooling and sealing of said compressor is located at the bottom of said housing of said compressor.

55. The compressor of claim 32 wherein said intake port located in said eccentric of said piston shaft is sequentially opened by said piston to communicate through said ports in said piston with said compression chambers when said compression chambers are at about their minimum volumes, and wherein said intake port located in said eccentric of said piston shaft is sequentially closed by said piston when said compression chambers are at about their maximum volumes.

56. The compressor of claim 32 wherein said discharge port located in said eccentric of said piston shaft is sequentially opened by said piston to communicate through said ports in said piston with said compression chambers when the pressure of gas undergoing compression in said compression chambers reaches desired level, and wherein said discharge port located in said eccentric of said piston shaft is sequentially closed by said piston when said compression chambers are at about their minimum volumes.

57. The compressor of claim 32 wherein said cylinder-piston further comprises suitable port fillers, with one of said port fillers attached to a surface of said body of said cylinder-piston defining one of surfaces of said opening in said cylinder-piston, and second of said port fillers attached to a surface of said connecting wall of said cylinder-piston and defining another of surfaces of said opening in said cylinder-piston, said port fillers provided to partially fill-in the spaces in said ports of said piston when the volumes of said compression chambers are at or close to their minimum volumes to decrease the so called dead or clearance volume of said compressor.

58. The compressor of claim 32 wherein said suitable pressure seal is a mechanical face seal.

59. The compressor of claim 43 wherein said lubricating and cooling means further comprise a suitable oil pump to circulate said lubricant in a manner required for operation of said compressor.

60. The compressor of claim 59 wherein said oil pump is driven from one end of said cylinder-piston shaft.

61. The compressor of claim 43 wherein said compressor further comprises suitable oil and pressure seals to seal said cylinder-piston shaft and said piston shaft to maintain certain pressure inside said housing of said compressor during its operation, and to prevent oil leaks from said housing of said compressor.

62. The compressor of claim 32 wherein said cylinder-piston shaft serves as a compressor power input shaft.

63. A compressible fluid compressing process comprising sequentially the steps of:

opening an intake port leading into a first compression chamber, said first compression chamber located between a piston, a body and two spaced walls of a cylinder-piston, and axially spaced stationary walls, as a result of overlapping of an intake port located in an eccentric portion of a piston shaft and rectangular port located in said piston caused by a rotation of said piston on said eccentric of said rotating piston shaft and when said first compression chamber is at about its minimum volume or shortly thereafter and after allowing for at least partial decompression of a residual compressed fluid;

opening and closing an opening in at least one of said parallel walls of said cylinder-piston by said piston to provide communication between a second compression chamber, said second compression chamber located between said piston, said two spaced walls and interconnecting them connecting wall of said cylinder-piston, and said axially spaced stationary walls, and inside of a housing of said compressor when the volume of said second compression chamber is at about its maximum volume;

closing an intake port leading into said second compression chamber caused by a rotation of said piston on said eccentric of said rotating piston shaft and when said second compression chamber is at about its maximum volume or shortly thereafter if such later closing of said intake port is required to supercharge said compressor;

passing said compressible fluid to be compressed from an intake channel of said piston shaft through said intake port in said eccentric of said piston shaft and said port in said piston into said first compression chamber while said volume of said first compression chamber increases as a result of the coordinated and opposite planetary rotations of said piston and said cylinder-piston with a distance between said piston and said body of said cylinder-piston increasing;

compressing said compressible fluid in said second compression chamber by decreasing said volume of said second compression chamber as a result of said coordinated and opposite planetary rotations of said cylinder-piston and said piston while said distance between said piston and said connecting wall connecting said two spaced walls of said cylinder-piston decreases;

opening a discharge port leading from said second compression chamber into a discharge channel of said piston shaft as a result of overlapping of a discharge port located in said eccentric portion of said piston shaft and said rectangular port located in said piston, and caused by said rotation of said piston on said eccentric of said rotating piston shaft and when a pressure of said compressible fluid being compressed in said second compression chamber reaches desired level, while continuing said intake process in said first compression chamber;

passing said compressed compressible fluid from said second compression chamber through said port in said piston and said discharge port in said eccentric portion of said piston shaft and into said discharge channel in said piston shaft and into a suitable receiver while said compression process in said second compression chamber continues and until said second compression chamber reaches its minimum volume, and while continuing said intake process in said first compression chamber;

closing said discharge port of said second compression chamber as a result of said rotation of said piston on said eccentric of said piston shaft when said second compression chamber is at about its minimum volume;

opening said intake port leading into said second compression chamber as a result of overlapping of said intake port located in said eccentric portion of said piston shaft and said rectangular port located in said piston caused by said rotation of said piston on said eccentric of said rotating piston shaft, when said first compression chamber is at about its minimum volume or shortly thereafter and after allowing for at least partial decompression of said residual compressed fluid;

opening and closing an opening in at least one of said parallel walls of said cylinder-piston by said piston to provide communication between said first compression chamber and inside of said housing of said compressor when the volume of said first compression chamber is at about its maximum volume;

closing said intake port of said first compression chamber as a result of said rotation of said piston on said eccentric of said rotating piston shaft when said first compression chamber is at about its maximum volume or shortly thereafter if such later closing of said intake port is required to supercharge said compressor;

compressing said compressible fluid in said first compression chamber by decreasing said volume of said first compression chamber as a result of said coordinated and opposite planetary rotations of said cylinder-piston and said piston while said distance between said piston and said body of said cylinder-piston decreases;

passing said compressible fluid to be compressed from said intake channel of said piston shaft through said intake port in said eccentric of said piston shaft and said port in said piston into said second compression chamber while said volume of said second compression chamber increases as a result of said coordinated and opposite planetary rotations of said piston and said cylinder-piston with said distance between said piston and said connecting wall connecting said two spaced walls of said cylinder-piston increasing;

opening said discharge port leading from said first compression chamber into said discharge channel of said piston shaft as a result of said overlapping of said discharge port located in said eccentric portion of said piston shaft and said rectangular port located in said piston, and caused by said rotation of said piston on said eccentric of said rotating piston shaft and when said pressure of said compressible fluid being compressed in said first compression chamber reaches desired level, while continuing said intake process in said second compression chamber;

passing said compressed compressible fluid from said first compression chamber through said port in said piston and discharge port in said eccentric portion of said piston shaft and into said discharge channel in said piston shaft and into said suitable receiver while said compression process in said first compression chamber continues and until said first compression chamber reaches its minimum volume, and while continuing said intake process in said second compression chamber;

closing said discharge port of said first compression chamber as said result of said rotation of said piston on said eccentric of said piston shaft when said first compression chamber is at about its said minimum volume; and repeating the cycle in said first and said second compression chambers.

64. The compressible fluid compressing process of claim 63 wherein said process further comprises an injection of suitable lubricant into said intake channel of said piston shaft to lubricate co-working surfaces of said first and said second compression chambers, to internally cool said compression process in said compression chambers, and to seal said compression chambers.

65. The compressible fluid compressing process of claim 63 wherein said communication between said compression chambers and said inside of said housing of said compressor through said opening in at least one of said parallel walls of said cylinder-piston opened and closed by said piston when said compression chambers are at or very close to their maximum volumes is provided to equalize pressure between said compression chambers and said housing of said compressor.

* * * * *